US007209940B1

(12) United States Patent
Guan

(10) Patent No.: US 7,209,940 B1
(45) Date of Patent: Apr. 24, 2007

(54) TEMPERATURE COMPENSATED SQUARE FUNCTION GENERATOR

(75) Inventor: Charles Guan, San Francisco, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 719 days.

(21) Appl. No.: 10/458,970

(22) Filed: Jun. 10, 2003

(51) Int. Cl.
*G06G 7/16* (2006.01)

(52) U.S. Cl. ..... 708/845

(58) Field of Classification Search ..... 708/845
See application file for complete search history.

(56) References Cited

U.S. PATENT DOCUMENTS 3,942,074 A * 3/1976 Graham ..... 361/96

5,412,290 A * 5/1995 Helfrich ..... 315/371

* cited by examiner

*Primary Examiner*—Tan V. Mai
(74) *Attorney, Agent, or Firm*—Darby & Darby PC; Matthew M. Gaffney

(57) ABSTRACT

Temperature compensation may be provided to a square function generator by adjusting a tail current of the square function generator. Temperature compensation of the square function generator may be provided, for example, by a second square function generator circuit and an error amplifier. The second square function generator may be substantially similar to the first square function generator. The error amplifier is arranged in cooperation with the first and second square function generators such that the output of the error amplifier adjusts the tail current of the square function generators. A plurality of temperature square function generators may be configured to provide a temperature-compensated cubic function. The temperature compensated cubic function may be used for S-correction in a display system such as a cathode ray tube.

20 Claims, 2 Drawing Sheets

TEMPERATURE COMPENSATED SQUARE FUNCTION GENERATOR

FIELD OF THE INVENTION

The present invention relates to square function generator circuits, and, in particular, to a square function generator circuit that is temperature compensated by adjusting a tail current of the square function generator. The square function generator circuits may be arranged to provide cubic functions, as well as others.

BACKGROUND OF THE INVENTION

In a cathode ray tube (CRT) display, a phosphor screen is located opposite an electron gun. The electron beam emits electrons. The electrons are accelerated and focused on the phosphor screen by a high voltage grid. The phosphor screen is periodically refreshed.

An image is displayed on a phosphor screen. The phosphor screen is divided up into a number of horizontal scan lines. The electron beam is directed to the upper left corner of the phosphor screen at the first scan line when a new image is displayed. The electron beam is steered horizontally across each scan line at a fixed frequency. The electron beam returns to the left side of the phosphor screen after the electron beam reaches the right edge of the phosphor screen, a process called horizontal retrace.

During horizontal retrace, the electron beam is steered (right to left) to the left edge of the next scan line, which is immediately beneath the previous scan line. The beam is steered back to the top left corner of the phosphor screen during the vertical retrace interval after all of the scan-lines are traced by the electron beam. A horizontal deflection circuit steers the beam horizontally. A vertical deflection circuit steers the beam vertically. The horizontal and vertical deflection circuits produce high voltage signals that activate deflection coils.

Typical vertical deflection circuits include a vertical oscillator circuit and vertical deflection coils. A vertical pulse signal is coupled into the vertical deflection circuits. The vertical oscillator circuit is triggered by the sync pulse so that the vertical oscillator locks to the refresh frequency. The vertical oscillator generates a saw tooth waveform. The saw tooth waveform is used to generate a current ramp. The current ramp drives the vertical deflection coils such that the electron beam is steered from the top of the phosphor screen to the bottom of the phosphor screen at a uniform rate. At the end of the current ramp, the electron beam is steered to the top of the screen.

A distortion occurs in the image as the electron beam is steered from the image area at the side of the phosphor screen in a vertical direction. The top and bottom of the phosphor screen have a higher deflection angle with respect to the middle of the phosphor screen. Typically, an S-correction is performed on the image data to correct the resulting image distortion on the display. The deflection current is used to generate the vertical scan via the deflection coils. The deflection current is arranged as a saw tooth waveform. The slanted portions of the saw tooth waveform are modified by S-correction in an "S" shape. The top and bottom section of the sawtooth each have a small slope which results in a smaller deflection area.

BRIEF DESCRIPTION OF THE DRAWINGS

Non-limiting and non-exhaustive embodiments of the present invention are described with reference to the following drawings.

DETAILED DESCRIPTION OF THE PREFERRED EMBODIMENT

Figure 1:
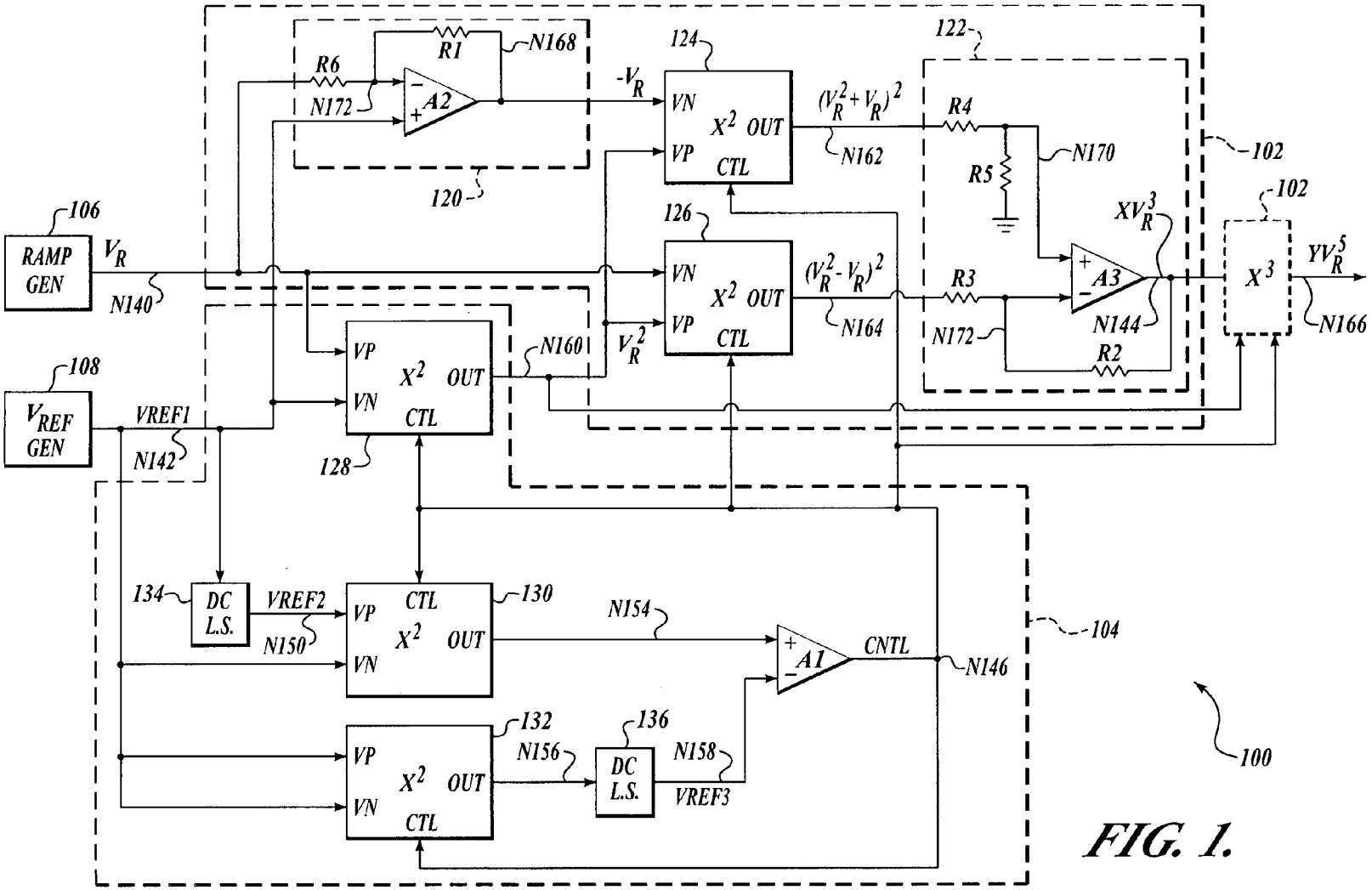
FIG. 1 is an illustration of an example embodiment of a temperature-compensated function generator circuit.

Throughout the specification and claims, the following terms take the meanings explicitly associated herein, unless the context clearly dictates otherwise. The meanings identified below are not intended to limit the terms, but merely provide illustrative examples for the terms. The meaning of "a," "an," and "the" includes plural reference, the meaning of "in" includes "in" and "on." The term "connected" means a direct electrical connection between the items connected, without any intermediate devices. The term "coupled" means either a direct electrical connection between the items connected, or an indirect connection through one or more passive or active intermediary devices. The term "circuit" means either a single component or a multiplicity of components, either active and/or passive, that are coupled together to provide a desired function. The term "signal" means at least one current, voltage, charge, temperature, data, or other signal. Referring to the drawings, like numbers indicate like parts throughout the views.

Overview

Briefly stated, temperature compensation may be provided to a square function generator by adjusting a tail current of the temperature compensated square function generator circuit (TCSFGC). Temperature compensation of the TCSFGC may be provided, for example, by a second TCSFGC and an error amplifier. The second TCSFGC may be substantially similar to the first TCSFGC. The error amplifier is arranged in cooperation with the first and second TCSFGCs such that the output of the error amplifier adjusts the tail current of the TCSFGCs. A plurality of TCSFGCs may be configured to provide a temperature-compensated cubic function. The temperature compensated cubic function may be used for S-correction in a display system such as a cathode ray tube.

An example embodiment of a temperature compensated cubic function generator circuit may include a ramp generator circuit that is configured to produce a ramp signal ($V_R$). The example temperature-compensated cubic function generator circuit is configured to provide an output signal having a voltage of $V_R^3$. The temperature-compensated cubic function generator circuit can be expanded to generate an $n^{th}$ order power function by cascading one or more temperature-compensated cubic function generator circuits.

Example System

FIG. 1 is an illustration of an example embodiment of a temperature-compensated function generator circuit (100) that is arranged in accordance with aspects of the current invention. Circuit 100 includes first and second temperature-compensated cubic function generator circuits (102), a temperature-compensated parabolic generator circuit (104), a ramp generator circuit (106), and a voltage reference generator circuit (108). An example embodiment of parabola generator circuit 104 includes TCSFGCs (128, 130, and 132), DC level shift circuits (134 and 136), and an error amplifier circuit (A1). An example embodiment of cubic function generator circuit 102 includes TCSFGCs (124, 126), an inverting amplifier circuit (120), and a difference circuit (122). An example embodiment of inverting amplifier circuit 120 includes an op amp circuit (A2) and resistors (R1, R6). An example of difference circuit 122 includes an op amp circuit (A3) and resistors (R2, R3, R4, R5). All of the TCSFGCs (128, 130, 132, 134, and 136) in circuit 100 are substantially similar.

Ramp generator circuit 106 has an output that is coupled to node N140. Voltage reference generator circuit 108 has an output that is coupled to node N142. DC level shift circuit 134 has an input that is coupled to node N142 and an output that is coupled to node N150. TCSFGC 130 has a non-inverting input (VP) that is coupled to node N150, an inverting input (VN) that is coupled to node N142, a control input (CLT) that is coupled to node N146, and an output (OUT) that is coupled to node N154.

TCSFGC 132 has a non-inverting input (VP) that is coupled to node N142, an inverting input (VN) that is coupled to node N142, a control input (CTL) that is coupled to node N146, and an output (OUT) that is coupled to node N156. DC level shift circuit 136 has an input that is coupled to node N156 and an output that is coupled to node N158. Error amplifier circuit A1 has a non-inverting input (+) that is coupled to node N154, an inverting input (−) that is coupled to node N158, and an output that is coupled to node N146.

TCSFGC 128 has a non-inverting input (VP) that is coupled to node N140, an inverting input (VN) that is coupled to node N142, a control input (CTL) that is coupled to node N146, and an output (OUT) that is coupled to node N160. Inverting amplifier circuit 120 has an inverting input that is coupled to node N140, a non-inverting input that is coupled to node N142, and an output that is coupled to node N168. TCSFGC 124 has a non-inverting input (VP) that is coupled to node N160, an inverting input (VN) that is coupled to node N168, a control input (CTL) that is coupled to node N146, and an output (OUT) that is coupled to node N162.

TCSFGC 126 has a non-inverting input (VP) that is coupled to node N160, an inverting input (VN) that is coupled to node N140, a control input (CTL) that is coupled to node N146, and an output (OUT) that is coupled to node N164. Difference circuit 122 has a first input that is coupled to node N162, a second input that is coupled to node N164, and an output that is coupled to node N144. The second cubic function generator circuit (102) has an input that is coupled to node N144 and an output that is coupled to node N166.

Producing $4V_R^3$ from $V_R$

The example embodiment of circuit 100 illustrated in FIG. 1 is configured to operate as follows below. Ramp generator circuit 106 is configured to provide signal $V_R$ at node N140. Signal $V_R$ is a saw tooth signal. Voltage reference generator circuit 108 is configured to provide a voltage reference signal ($V_{REF1}$) at node N142. Signal $V_{REF1}$ is approximately a DC signal. Circuit 100 provides an output signal at node N144 in response to signal $V_R$ and signal $V_{REF1}$. The output signal has a voltage of approximately $4V^{R3}$ according to the equation $(V_R^2+V_R)^2-(V_R^2-V_R)^2=4V_R^3$. The generation of the output signal is explained in greater detail below.

Each of the TCSFGCs (124, 126, 128, 130, 132) is configured to produce an output signal having a voltage equal to $(VP-VN)^2$, where VP corresponds to the voltage of the signal at the non-inverting input, and VN corresponds to the voltage of the signal at the inverting input.

TCSFGC 128 is configured to provide a signal at node N160 in response to signal $V_R$ and signal $V_{REF1}$. The signal at node N160 has a voltage of $V_R^2$ (ignoring the DC level for $V_{REF1}$). Signal $V_{REF1}$ corresponds to a center reference voltage that is selected to optimize the operating range of TCSFGC 128. According to one example, the operating range is 500 mV peak to peak (e.g. 2.25V–2.75V), and therefore signal $V_{REF1}$ has a voltage of 2.5V. Inverting amplifier circuit 120 is configured to provide a signal at node N168 in response to signal $V_R$ and signal $V_{REF1}$. According to one example, inverting amplifier circuit 120 has a gain of approximately −1. Therefore the signal at node N168 has a voltage of approximately $-V_R$ (ignoring the DC level for $V_{REF1}$). Square generator circuit 124 is configured to provide a signal at node N162 in response to the signals at node N160 and node N168. The signal at node N162 has a voltage of approximately $(V_R^2+V_R)^2$. Square generator circuit 126 is configured to provide a signal at node N164 in response to signals at node N160 and node N140. The signal at node N164 has a voltage of approximately $(V_R^2-V_R)^2$. Difference circuit 122 is configured to provide a signal at node N144 with a voltage that is the difference of the voltage of the signals at the inputs of difference circuit 122 at nodes N162 and N164. Therefore, the voltage at node N144 is equal to approximately $(V_R^2+V_R)^2-(V_R^2-V_R)^2$, or $4V_R^3$. The output voltage can be scaled by selection of various gain-setting components in circuit 100 such that the signal at node N144 has a voltage of $X*V_R^3$.

Producing $16V_R^5$

The second cubic generator circuit (102) is an optional component of circuit 100. The second cubic generator circuit (102) is substantially similar to the first cubic generator circuit (102). The second cubic generator circuit (102) is configured to provide a signal at node N166 in response to the signal at node N144, the signal at node N160, and a signal (CNTL) at node N146. The signal at node N166 has a voltage of $16V_R^5$. The output voltage can be scaled by selection of various gain-setting components in circuit 100 such that the signal at node N166 has a voltage of $Y*V_R^5$.

Temperature Compensation

Temperature compensation each of the TCSFGCs (124, 126, 128, 130, 132) is provided by signal CNTL, which adjusts a tail current in each of the TCSFGCs (124, 126, 128, 130, 132).

Signal CNTL is produced as follows below. DC level shift circuit 134 is configured to provide signal $V_{REF2}$ at node N150 in response to signal $V_{REF1}$. According to one example, the operating range of TCSFGC 128 is 500 mV peak to peak. In this example, signal $V_{REF2}$ has a voltage of 250 mV+$V_{REF1}$, since $(500\text{ mV})^2$ is equal to 250 mV. TCSFGC 130 is configured to provide a signal at node N154 in response to signal $V_{REF2}$ and signal $V_{REF1}$. Error amplifier circuit A2 is configured to provide signal CNTL at node N146 in response to the signal at node N154 and signal $V_{REF3}$. Signal $V_{REF3}$ is related to an offset error for the TCSFGCs. Signal CNTL drives a tail current in each of the TCSFGCs.

Since the reference voltages ($V_{REF1}$, $V_{REF2}$, and $V_{REF3}$) are DC levels, signal CNTL is a DC level that is servoed to a value using feedback. Error amplifier A1 is arranged in cooperation with TCSFGC 130 and TCSFGC 132 to adjust signal CNTL such that the voltages at node N154 and node N158 to match each other. The tail current in the TCSFGCs is adjusted when signal CNTL is adjusted. The gain that is associated with the TCSFGCs and the offset error that is associated with the TCSFGCs is adjusted when the tail current in the TCSFGCs is adjusted. Therefore, the TCSFGCs are compensated for offset error and other sources of error when signal CNTL is servoed to a value using feedback.

According to one example embodiment, signal $V_{REF3}$ is produced as follows below. TCSFGC 132 is configured to provide a signal at node N156 in response to signal $V_{REF1}$. Signal $V_{REF1}$ is provided at both the inverting and non-inverting inputs of TCSFGC 132. The signal at node N156 corresponds to an offset error of TCSFGC 132. DC level shift circuit 136 is configured to provide signal $V_{REF3}$ at node N158 in response to the signal at node N156.

Circuit 100 may be used to provide temperature-compensated S-correction of a CRT. Alternatively, circuit 100 may be used for other applications. An example equation for vertical S-correction is: $y=DC+a*x+b*x^3$, where "a" and "b" are constants, "x" is a linear ramp waveform, "DC" is an offset voltage, and "y" is the S corrected ramp function. A temperature-compensated cubic function generator circuit can be used to provide temperature-compensated S-correction.

Alternative embodiments are within the scope of the present invention. Although the example of circuit 100 shown in FIG. 1 provides a saw tooth signal at node N140, alternatively, other signals may be provided at node N140. Circuit 100 may include components with operating ranges other than the operating ranges described above. Circuit 100 may be modified to generate any $n^{th}$ order power function. The reference signals ($V_{REF1}$, $V_{REF2}$, and $V_{REF3}$) may be generated by other means than illustrated in FIG. 1. For the difference circuit 122, illustrated in FIG. 1, amplitude error may be reduced by adjusting resistors R2, R3, R4, and R5. The embodiment of an inverting amplifier circuit (120) illustrated in FIG. 1 may be replaced by an alternative embodiment of an amplifier circuit. The embodiment of a difference circuit (122) illustrated in FIG. 1 may be replaced by an alternative embodiment of a difference circuit.

Example Temperature Compensated Parabola Generator Circuit

Figure 2:
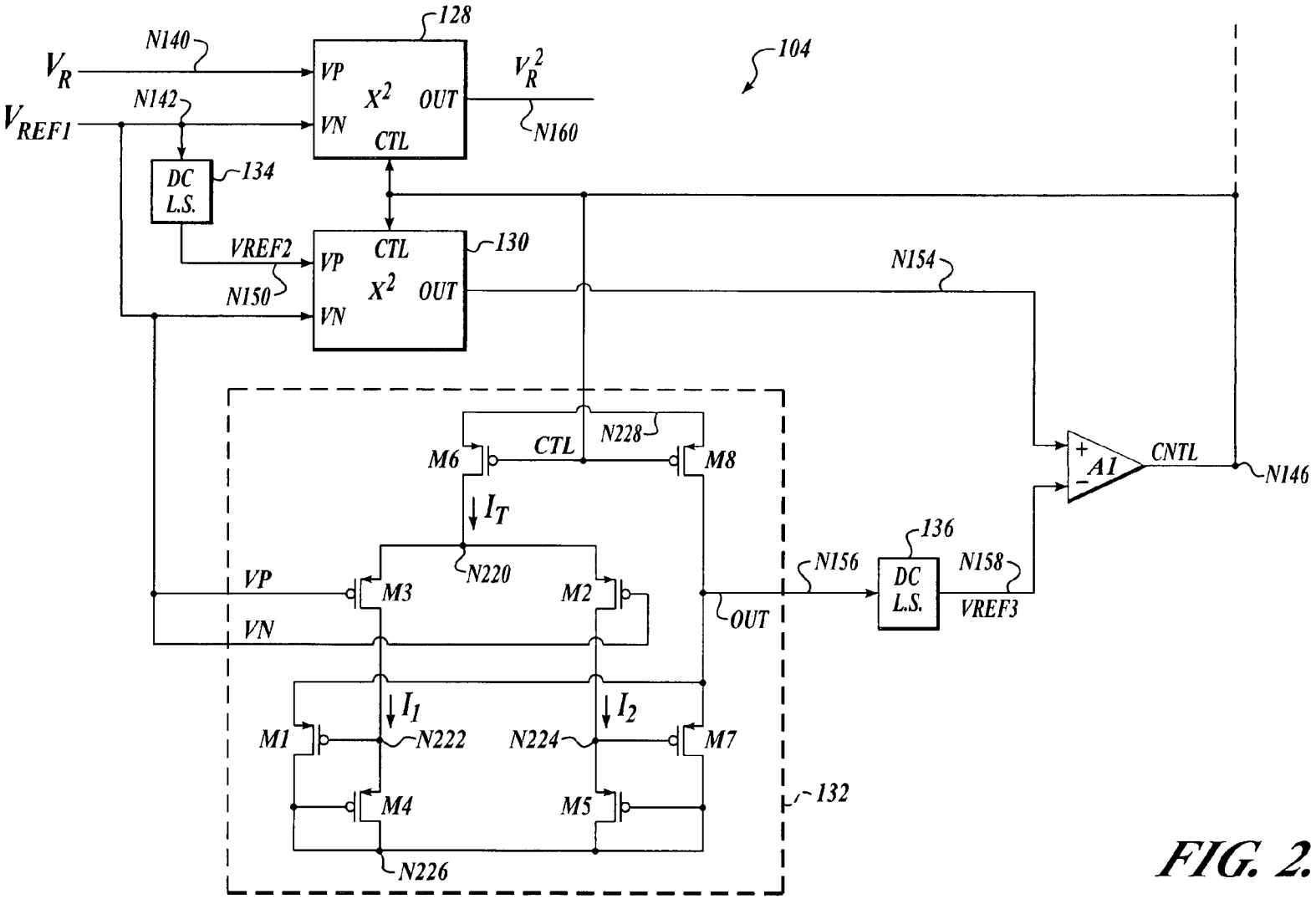
FIG. 2 is an illustration an example embodiment of a temperature-compensated parabola generator, arranged in accordance with aspects of the present invention.

FIG. 2 is an illustration an example embodiment of the temperature-compensated parabola generator circuit (104) that is arranged in accordance with aspects of the present invention. Example parabola generator circuit 104 is substantially similar to the parabola generator circuit (104) illustrated in FIG. 1. In FIG. 2, an example embodiment of TCSFGC 132 is illustrated in greater detail. The example embodiment of TCSFGC 132 includes transistors (M1–M8). The other TCSFGCs (124, 126, 128, and 130) are substantially similar to TCSFGC 132.

Transistor M1 has a gate that is coupled to node N222, a source that is coupled to node N156, and a drain that is coupled to node N226. Transistor M2 has a gate that is coupled to node N142, a source that is coupled to node N220, and a drain that is coupled to node N224. Transistor M3 has a gate that is coupled to node N142, a source that is coupled to node N220, and a drain that is coupled to node N222. Transistor M4 has a gate that is coupled to node N226, a source that is coupled to node N222, and a drain that is coupled to node N226. Transistor M5 has a gate that is coupled to node N226, a source that is coupled to node N224, and a drain that is coupled to node N226. Transistor M6 has a gate that is coupled to node N146, a source that is coupled to node N228, and a drain that is coupled to node N220. Transistor M7 has a gate that is coupled to node N224, a source that is coupled to node N156, and a drain that is coupled to node N226. Transistor M8 has a gate that is coupled to node N146, a source that is coupled to node N228, and a drain that is coupled to node N156.

The example embodiment of parabola generator circuit 104 illustrated in FIG. 2 is configured to operate as follows below.

TCSFGC 132 includes a differential input stage. The inverting input (VN) of the differential input stage corresponds to the gate of M2, and the non-inverting input (VP) of the differential input stage corresponds to the gate of M3. Transistors M6 is configured as a current source that provides the tail current (IT). Transistor M8 is configured as another current source that provides another current. Transistors M4 and M5 are configured as resistive loads.

Transistors M4 and M5 are further configured to perform a trans-impedance squaring function. The drain current of a MOSFET in the saturation region of operation is approximately given by: $I_D\ \alpha(V_{GS}-V_T)^2$. The voltages at nodes N222 and N224 are determined by: $I1*R_{M4}$ and $I2*R_{M5}$ respectively, where $R_{M4}$ corresponds to the on resistance of transistor M4, and $R_{M5}$ corresponds to the on resistance of transistor M5.

Transistors M1 and M7 are configured as source followers. The voltage at node N222 is buffered by transistor M1. The voltage at node N224 is buffered by transistor M7. The voltages from transistor M1 and transistor M7 are combined at node N156. Combining the two voltages eliminates common terms such as $V_T$, so that the voltage of the output signal at node N156 is the square of the voltage of the differential input signal.

The gates of transistors M6 and M8 correspond to the control input for TCSFGC 132. Error amplifier circuit A1 is configured to adjust the tail current of TCSFGC 132 by driving transistors M6 and M8. Since the reference voltages ($V_{REF1}$, $V_{REF2}$, and $V_{REF3}$) are DC levels, signal CNTL also a DC level that is servoed by feedback. The offset in the TCSFGCs is adjusted by adjusting the tail current of the TCSFGCs.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A temperature compensated function generator circuit, comprising:

a first square function generator circuit, wherein the first square generator circuit includes a first non-inverting input, a first inverting input, a first control input, and a first output, wherein the first square function generator is capable of receiving an input signal via the first non-inverting input;

a second square function generator circuit, wherein the second square generator circuit includes a second non-inverting input, a second inverting input, a second control input, and a second output;

a third square function generator circuit, wherein the third square generator circuit includes a third non-inverting input, a third inverting input, a third control input, and a third output, wherein the first, second, and third inverting inputs are coupled together, wherein the second non-inverting input is coupled to the first inverting input, and wherein the third non-inverting input is coupled to the third inverting input; and an error amplifier circuit, wherein the error amplifier circuit includes: an inverting error amplifier input that is coupled to the third output, a non-inverting error amplifier input that is coupled to the second output, and an error amplifier output that is coupled to the first, second, and third control inputs.

2. The temperature compensated function generator circuit as in claim 1, wherein each of the square function generator circuits is configured to provide a signal at the output of the square function generator circuit having a voltage that corresponds to approximately $(VP-VN)^2$, wherein VP and VN correspond to voltages that are applied to a respective one of the non-inverting input and the inverting input of the square function generator circuit; and wherein the error amplifier circuit is arranged in cooperation with the second and third square function generator circuits to adjust a tail current in each of the square function generator circuits such that an error associated with each of the square function generator circuits is compensated via feedback.

3. The temperature compensated function generator circuit as in claim 1, further comprising:

a first DC level shift circuit that is coupled between the first inverting input and the second non-inverting input; and a second DC level shift circuit that is coupled between the third output and the non-inverting error amplifier input, wherein at least one characteristic of the first and second DC level shift circuits are approximately matched to one another.

4. The temperature compensated function generator circuit as in claim 1, further comprising: a voltage reference generator circuit having a reference output that is coupled to the first inverting input.

5. The temperature compensated function generator circuit as in claim 1, further comprising: a ramp generator circuit having a ramp output that is coupled to the first non-inverting input.

6. The temperature compensated function generator circuit as in claim 1, further comprising:

an inverting amplifier circuit having an inverting amplifier input that is coupled to the first non-inverting input;

a fourth square function generator circuit, wherein the fourth square generator circuit includes a fourth non-inverting input, a fourth inverting input, a fourth control input, and a fourth output, wherein the fourth inverting input is coupled to an output of the first inverting amplifier circuit, the fourth non-inverting input is coupled to the first output, and wherein the fourth control input is coupled to the error amplifier output;

a fifth square function generator circuit, wherein the fifth square generator circuit includes a fifth non-inverting input, a fifth inverting input, a fifth control input, and a fifth output, wherein the fifth inverting input is coupled to an output of the first inverting amplifier circuit, the fifth non-inverting input is coupled to the first output, and wherein the fifth control input is coupled to the error amplifier output; and a difference circuit, wherein the first difference circuit includes a first difference input that is coupled to the fourth output, a second difference input that is coupled to the fifth output, and a difference output, whereby the difference output is associated with a cubic function.

7. The temperature compensated function generator circuit as in claim 6, wherein the difference circuit comprises:

a first op-amp circuit, wherein the first op-amp circuit includes an inverting op-amp input, a non-inverting op-amp input, and an op-amp output;

a first resistor that is coupled between the op-amp output and the inverting op-amp input;

a second resistor that is coupled between the fifth output and the inverting op-amp input;

a third resistor that is coupled between the fourth output and the non-inverting op-amp input; and a fourth resistor that is coupled to the non-inverting op-amp input.

8. The temperature compensated function generator circuit as in claim 6, further comprising:

a second inverting amplifier circuit having a second inverting amplifier input that is coupled the first output, and a second inverting amplifier output;

a sixth square function generator circuit having a sixth non-inverting input that is coupled to the first non-inverting input, a sixth inverting input that is coupled to the difference output, and a sixth control input that is coupled to the error amplifier output;

a seventh square function generator circuit having a seventh non-inverting input that is coupled to the first non-inverting input, a seventh inverting input that is coupled to the second inverting amplifier output, and a seventh control input that is coupled to the error amplifier output; and a second difference circuit, wherein the second difference circuit includes a third difference input that is coupled to the sixth output, a fourth difference input that is coupled to the seventh output, and a second difference output, whereby the second difference output is associated with a quintic function.

9. A temperature compensated function generator circuit as in claim 1, wherein each of the square function generator circuits comprises:

a first transistor, wherein a gate associated with the first transistor corresponds to a first input;

a second transistor having a source that is coupled to a source of the first transistor, wherein a gate associated with the second transistor corresponds to a second input;

a third transistor having a drain that is coupled to the source of the first transistor, a fourth transistor having a gate that is coupled to a gate of the third transistor, a source that is coupled to a source of the third transistor, and a drain that is coupled to a drain of the first transistor and a drain of the second transistor, wherein the drain of the fourth transistor is associated with an output;

a first current-limiting device that is coupled between the drain of the first transistor and a first node, and a second current-limiting device that is coupled between the drain of the second transistor and the first node.

10. The temperature compensated function generator circuit as in claim 9, wherein each of the square function generators further comprises:

a first buffer circuit, wherein the drain of the first transistor is coupled to the drain of the fourth transistor through the first buffer circuit; and a second buffer circuit, wherein the drain of the second transistor is coupled to the drain of the fourth transistor through the second buffer circuit.

11. The temperature compensated function generator circuit as in claim 10, wherein the first and second buffer circuits are source followers.

12. The temperature compensated function generator circuit as in claim 9:

wherein the first current-limiting circuit comprises a fifth transistor having a source that is coupled to the drain of the first transistor, a gate that is coupled to the first node, and a drain that is coupled to the first node; and the second current-limiting circuit comprises a sixth transistor having a source that is coupled to the drain of the second transistor, a gate that is coupled to the first node, and a drain that is coupled to the first node.

13. A temperature compensated function generator circuit, comprising:

a first square function generator circuit; and a means for compensation that is configured to provide temperature compensation for the first square function generator circuit by adjusting a tail current that is associated with the first square function generator circuit.

14. The temperature compensated function generator circuit as in claim 13, wherein the first square function generator circuit is configured to receive a first reference signal, and wherein the means for compensation comprises:

a second square function generator circuit having an inverting input that is configured to receive the first reference signal, and further having a non-inverting input that is configured to receive a second reference signal, wherein the second reference signal is related to the first reference signal, and the second square function generator circuit is substantially similar to the first square function generator circuit; and an error amplifier circuit having a non-inverting input that is coupled to the output of the second square function generator circuit, an inverting input that is configured to receive a third reference signal, and an output that is coupled to the first and square function generator circuits such that the error amplifier circuit is arranged to adjust a tail current of the first and second square function generator circuits, wherein the third reference signal is related to an offset error the second square function generator circuit, and wherein the error amplifier circuit is arranged in cooperation with the second square function generator circuit to adjust a tail current of the first and second square function generator circuit such that each of the square function generator circuits is compensated via feedback.

15. The temperature compensated function generator circuit as in claim 14, further comprising: a first level shift means that is configured to provide the second reference signal by shifting a DC level that is associated with the first reference signal.

16. The temperature compensated function generator circuit as in claim 15, further comprising:

a third square function generator circuit having an inverting input that is configured to receive the first reference signal, and further having a non-inverting input that is configured to receive the first reference signal, wherein the third square function generator circuit is coupled to the output of the error amplifier circuit such that the error amplifier circuit is arranged to adjust the tail current of the third square function generator circuit; and a second level shift means that is configured to provide the third reference signal by shifting another DC level that is associated with an output of the third square function generator circuit.

17. The temperature compensated function generator circuit as in claim 14, wherein the first and second square function generator circuits each comprise:

a first transistor having a gate that corresponds to the non-inverting input of the square function generator circuit;

a second transistor having a source that is coupled to a source of the first transistor, and a gate that corresponds to the inverting output of the square function generator circuit;

a third transistor having a drain that is coupled to the source of the first transistor, and a gate that is coupled to the output of the error amplifier circuit;

a fourth transistor having a gate that is coupled to a gate of the third transistor, a source that is coupled to a source of the third transistor, and a drain that is coupled to a drain of the first transistor and a drain of the second transistor, wherein the drain of the fourth transistor corresponds to the output of the square function generator circuit;

a first means for current limiting that is coupled between the drain of the first transistor and a first node; and a second means for current limiting that is coupled between the drain of the second transistor and the first node.

18. The temperature compensated function generator circuit as in claim 17, wherein each of the plurality of square function generator circuits further comprises:

a first means for buffering having an input that is coupled to the drain of the first transistor, and an output that is coupled to the drain of the fourth transistor; and a second means for buffering having an input that is coupled to the drain of the second transistor, and an output that is coupled to the drain of the fourth transistor.

19. A temperature compensated function generator circuit, comprising:

a first square function generator means;

a second square function generator means that is matched to the first square function generator means;

a means for generating an error signal with the second square function generator means, wherein the error signal includes a temperature based error that is associated with the second square function generator means; and a means for compensation that is configured to adjust a control signal in response to the error signal such that an operating current associated with the first and second square function generator is adjusted to compensate for the temperature based error.

20. A temperature compensated function generator circuit as in claim 19, further comprising: a third square function generator means that is matched to the first and second square function generator means, wherein the third square function generator means is configured to provide a reference signal to the means for generating an error signal.

* * * * *